US005332437A

United States Patent [19]

Davene et al.

[11] Patent Number: 5,332,437

[45] Date of Patent: Jul. 26, 1994

[54] AIR KNIFE DEVICE FOR REGULATING A METAL DEPOSIT

[75] Inventors: Jean Davene, Marly le Roi; Laurent Dondin, St Georges de Mons; Joseph Michalon, Cellieu; Fernando Yanez, St Chamond, all of France

[73] Assignee: Clecim, Cergy-Pontoise, France

[21] Appl. No.: 47,210

[22] Filed: Apr. 16, 1993

[30] Foreign Application Priority Data

Apr. 17, 1992 [FR] France ..... 92 04819

[51] Int. Cl.[5] ..... B05B 1/04

[52] U.S. Cl. ..... 118/63; 118/423; 427/348; 427/349; 15/309.1

[58] Field of Search ..... 118/63, 423; 427/348, 427/349, 433; 15/309.1

[56] References Cited

U.S. PATENT DOCUMENTS

| | | | |
|---|---|---|---|
| 3,841,557 | 10/1974 | Atkinson et al. | 239/11 |
| 4,346,129 | 8/1982 | Decker et al. | 118/63 |
| 4,515,313 | 5/1985 | Cavanagh | 239/455 |
| 4,697,542 | 10/1987 | Kohler | 118/63 |

FOREIGN PATENT DOCUMENTS

| | | | |
|---|---|---|---|
| 0186564 | 7/1986 | European Pat. Off. . | |
| 2090313 | 1/1972 | France . | |
| 2136041 | 12/1972 | France . | |
| 2424112 | 11/1979 | France . | |
| 2133055 | 6/1987 | Japan | 118/63 |
| 2133057 | 6/1987 | Japan | 118/63 |
| 923761 | 4/1982 | U.S.S.R. | 118/63 |

OTHER PUBLICATIONS

"Method and Device for Controlling Weight of Hot Dip Plated Zinc in Continuous Zinc Hot Dipping", Japanese Abstract 58-3959, Oct. 1985.

"Method for Controlling Nozzle Slit Gap of Blowing and Wiping-Off Apparatus Used in Molten Metal Plating Device", Jap. Abs. 59-41460, Mar. 1984.

*Primary Examiner*—W. Gary Jones
*Assistant Examiner*—John Hoffman
*Attorney, Agent, or Firm*—Pollock, Vande Sande & Priddy

[57] ABSTRACT

A device for regulating the thickness of a metal deposit formed on a strip emerging from a galvanization bath, comprising at least one nozzle for blowing air provided between the opposite, narrowly spaced ends of two jars. The air knife forming slot is delimited by two flat, parallel faces defining the direction of the air blade, one of these faces being provided on a deformable lip extending inside a hollow provided at the end of a first jaw and being slidable along a flat retaining face substantially perpendicular to the direction of the air knife and deforming the flat face by the action of an arrangement to adjust the width of the slot.

17 Claims, 3 Drawing Sheets

AIR KNIFE DEVICE FOR REGULATING A METAL DEPOSIT

FIELD OF THE INVENTION

The present invention relates to an air knife device for regulating the thickness of a zinc deposit on a strip leaving the galvanization bath in a hot galvanization line.

BACKGROUND OF THE INVENTION

Air knife type systems conventionally comprise two blower nozzles arranged respectively on either side of the strip to be galvanized, in the area where the strip emerges from the galvanization bath. These two air knives are blown onto each side of the strip. These nozzles extend over the whole width of the strip, the plane of the air knives being substantially perpendicular to the main plane of the strip. The thickness of the zinc deposit obtained depends on the force of impact of the air knives on the strip which can be adjusted by acting on the pressure of the air in the nozzle or on the nozzle-to-strip distance.

This kind of nozzle is described, for example, in FR-A-2 090.313 and generally comprises an air supply and distribution chamber which opens into an acceleration chamber, delimited by two jaws which converge up to an opening delimited by two opposing lips, narrowly spaced so as to form an air knife blown in the direction of the strip.

In this arrangement, one of the jaws is fixed and the other deformable by the action of a plurality of push rods distributed over the whole of its length in order to vary the thickness of the fluid knife from its edges up to the center of the metal strip. This push rod is associated with an adjustment device individually actuated by a rod extending above the zinc bath and therefore subjected to the heat radiated by the zinc bath. Such an adjustment method is therefore not very accurate and difficult to control remotely.

In addition, to vary the thickness of the air knife, the moving jaw, whose base is embedded, on the side opposite the opening, on the wall of the distribution chamber, has a taper or slot which allows it to deform by pivoting about this slot in order to adjust the width of the air knife. As a result, the profile of the air knife, in cross-section, will become more or less flared as the thickness of the air knife is adjusted, and cause the pressure of the air jet to vary on the strip.

In another arrangement, described in document US-A-3.841.557, the width of the opening is adjusted by means of a series of electric elements placed inside one of the jaws and distributed over its entire length, the jaw also having a cooling system. The width of the slot is adjusted by a bimetallic-type action and can therefore be remotely controlled, but its range of adjustment is necessarily limited. Moreover, such an arrangement is fairly complicated and costly.

SUMMARY OF THE INVENTION

The present invention overcomes such drawbacks, its object being a new device for shaping an air knife used to regulate a metal deposit, which, by simple means, makes it possible to dynamically adjust the thickness of the air knife during the passage of the strip, and to control such an adjustment remotely. Moreover, the cross-section of the air outlet slot is rectangular which makes it possible to obtain a true knife action, the profile of the air knife not being modified by adjustments to the thickness of the slot.

The device therefore comprises at least one nozzle for blowing a gaseous fluid such as air, associated with a distribution chamber connected to an air supply circuit and opening into an slot-shaped opening extending transversely over the entire width of the strip and delimited by two narrowly spaced, opposing lips provided respectively at the ends of the two jaws, respectively a first jaw and a second jaw, converging towards each other from the outlet of the distribution chamber up to the slot in order to form the air knife, in a mean direction transverse to the feed plane of the strip B, at least one of the said jaws being elastically deformable and associated with means for adjusting its profile distributed over its entire length for the adjustment of the width of the slot.

In accordance with the invention, the slot which forms the air knife A is delimited by two flat, parallel faces defining the direction of the air knife A, one of the limiting faces being provided on a deformable lip made up of a shaped element made of an elastically deformable, flexible material extending to the inside of a hollow provided at the end of a first jaw and delimited, on the upstream side in relation to the air flow, by a flat retaining face substantially perpendicular to the direction of the air knife A, the shaped element comprising, on the upstream side, a corresponding guiding and sealing face, which bears against the retaining face, the shaped element deforming by the action of the means for adjusting the slot width, with displacement of the flat face parallel to itself and sliding of the guiding face along the retaining face of the jaw.

In a particularly advantageous embodiment, the flat face of the deformable lip extends, in the air flow direction, over a distance equal to several times the maximum width of the slot. The face opposite the fixed lip is provided, preferably, on an enlarged part of the second jaw and extends substantially over the same width as the deformable lip.

In a preferred embodiment, the flexible shaped element forming the deformable lip comprises a part in the form of an elongated strip on which is provided the flat limiting face of the slot and, at least on the upstream side, a stiffening rib on which is provided the guide face which bears against the retaining face.

Preferably, the means for adjusting the slot width are formed from a plurality of jacks, possibly hydraulic, air or grease jacks, which are regularly distributed over the entire length of the deformable lip, these jacks being individually actuated by an automatic system for adjusting the width of the opening over its entire length according to the different parameters determining the thickness of the metal deposit. In particular, this type of automatic system can comprise a single gauge, which can be displaced over the width of the strip, or a plurality of gauges, for measuring the thickness of the deposit on the strip after it has passed in front of the nozzle or nozzles, the gauge or gauges being associated with means for slaving the position of the adjustment jacks to the thickness of the deposit recorded by the gauges.

To adjust the width of the opening, the automatic system particularly takes account of the vibrations of the strip measured with respect to a mean position, as well as the temperature and pressure of the air in the distribution chamber, and monitors the position of each adjustment means by means of its associated sensor.

In a particularly advantageous embodiment, the first support jaw of the deformable lip extends in a direction substantially vertical and parallel to the direction in which strip B leaves the galvanization bath, and the second jaw in a direction substantially parallel to the surface of the bath.

Moreover, the adjustment jacks are preferably placed in a hollow part provided on the outer face of the first jaw, and an insulating shield, fixed onto the first jaw, is interposed between the strip B and the jacks and closes towards the outside of the hollow part, the latter being associated with air blowing means for cooling.

To ensure perfect regulation of the air knife, the slot must also be perfectly clear over its whole length. For this purpose, each nozzle can advantageously be associated with a slot cleaning device comprising a blade which penetrates between the opposed faces of the two lips and which extends over the whole of their width, the blade being mounted on a carriage which can move along the two jaws over the whole length of the slot and which is associated with means for controlling its alternating movement in one direction and in the other.

A further object of the invention is a galvanization unit comprising such a system.

BRIEF DESCRIPTION OF THE DRAWINGS

The following description of a particular embodiment of the invention is purely illustrative and must be read in conjunction with the attached drawings wherein.

DETAILED DESCRIPTION

Figure 1:
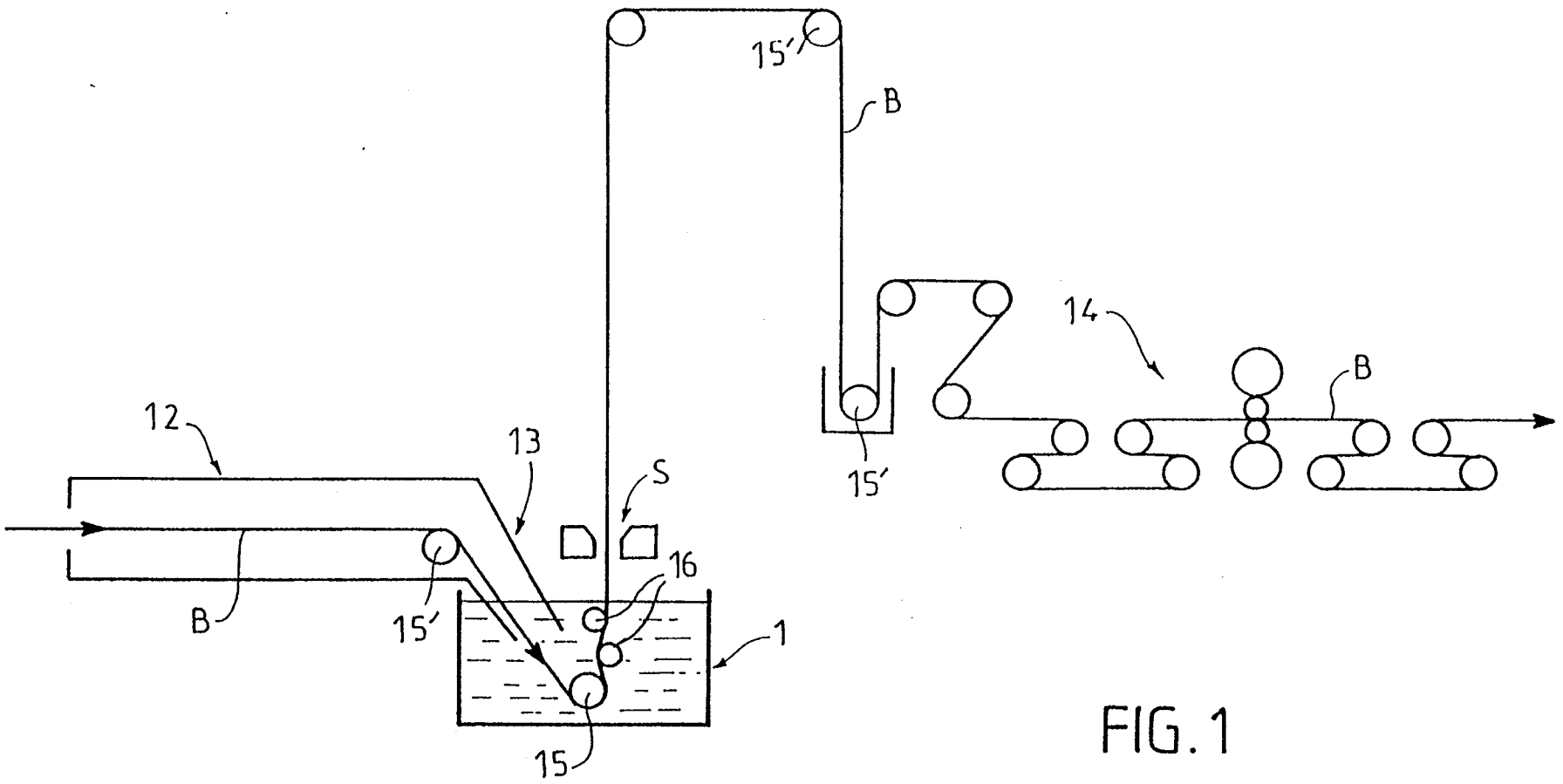
FIG. 1 shows a schematic drawing of a not galvanization unit comprising an air knife system in accordance with the invention.

The galvanization equipment shown schematically in FIG. 1 comprises, as is customary, an elongated vat filled with a galvanization bath 1 of molten zinc through which a strip B is passed after leaving a conventional processing line 12 such as heat treatment ovens, followed by a cooling area 13.

The path of the strip through bath 1 is determined by deflecting rollers 15' and a lower roller 15 immersed in the bath 1. Rollers 16 serve to guide and stabilize the strip B, which leaves the bath in a substantially vertical direction.

Immediately after leaving the galvanization bath 1, the strip B passes into a device that regulates the thickness of the zinc coating. This device comprises two nozzles L1, L2, placed on either side of the strip B and projecting an air knife onto each face of the strip B, the air knife being directed onto the strip in a plane substantially perpendicular to it. The strip B is then directed to the succeeding installation, such as skin-pass laminator 14.

Figure 2:
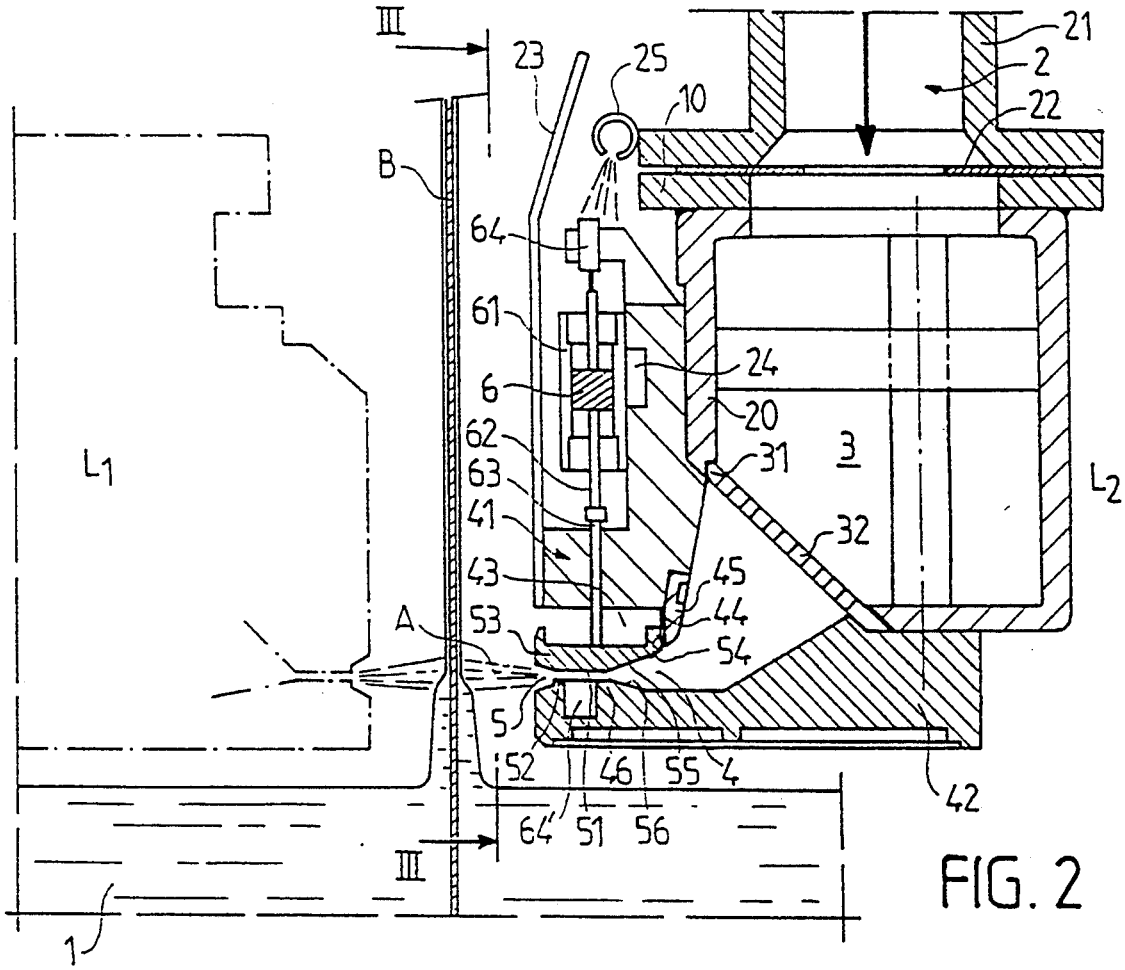
FIG. 2 shows a cross-sectional view of the blower nozzles of a system in accordance with the invention.
Figure 3:
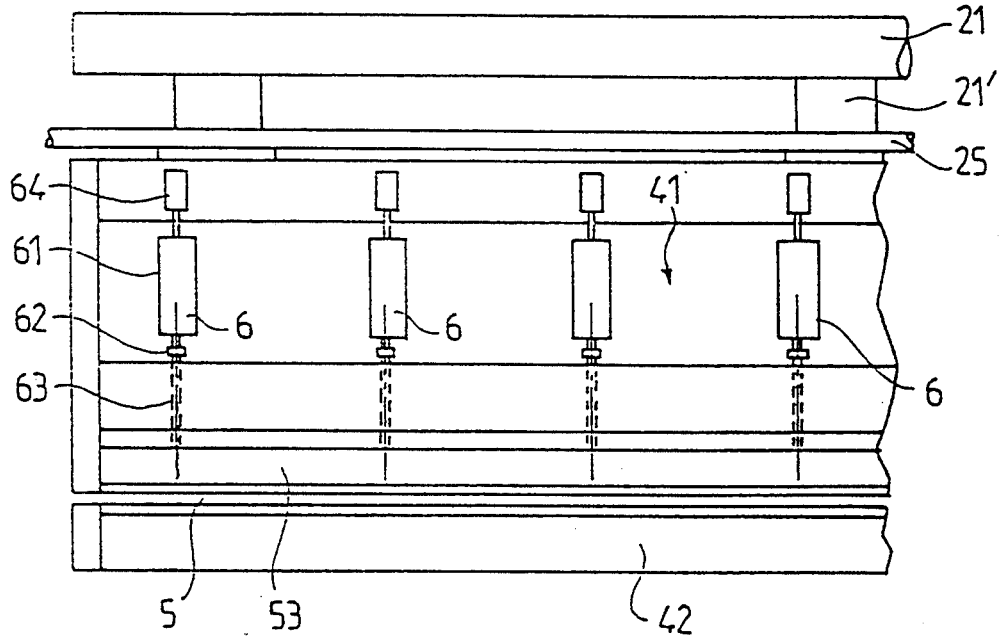
FIG. 3 is a view taken along the line III—III of FIG. 2.

FIGS. 2 and 3 show, respectively, a transverse cross-section and front elevation of an air-knife blowing nozzle S in accordance with the invention.

Referring to FIG. 2, the device S comprises two identical nozzles L1 and L2 arranged on either side of the strip B. Each nozzle is connected to a circuit 2 supplying air under pressure which opens into a chamber 3 designed to uniformly distribute the air flow and ensure equal pressure over the entire length of the respective nozzle.

Chamber 3 could, for example, be in the form of a parallelepipedal rectangle whose bottom is substantially horizontal. The side of chamber 3 nearest galvanization bath 1 and strip B has an opening 31 for expelling air towards an acceleration chamber 4 delimited by two jaws 41, 42 which are fixed to the walls of chamber 3 on either side of opening 31. The inner faces of jaws 41, 42 converge towards each other so that the transverse cross-section of the chamber 4 tapers gradually up to an outlet opening 5 delimited by two, slightly open, opposed lips 51, 52, provided respectively on the ends facing upper jaw 41 and lower jaw 42.

Preferably, lower jaw 42 extends horizontally above galvanization bath 1 in the direction of strip B, while upper jaw 41 extends substantially parallel to strip B in the direction of the jaw 42 with which it forms the opening of nozzle L1 (L2) in the form of a slot 5. The parts facing jaws 41 and 42 converge towards each other up to opening 5, thus forming a throttling and acceleration area for air arriving from chamber 3 which is evacuated through opening 5. A perforated sheet 32 is interposed in opening 31 to correctly distribute the air arriving from chamber 3.

The upper jaw 41, which extends in a direction substantially parallel to strip B, has at its lower end facing lower jaw 42, a housing 43 which is delimited, on the side of chamber 3, by a vertical wall 44.

In the example shown, upper jaw 41 comprises an elongated piece fixed onto the front wall 20 of the distribution chamber 3. This elongated piece is prolonged at its base, on the side of chamber 4, by a plate 45 which descends below the level of the lower end of jaw 41 so as to delimit, with this jaw, housing 43 in which a shaped element 53 made of elastically deformable flexible material is placed, the lower face 51 of which forms the moving lip of slot 5.

The height of housing 43, determined by the vertical face 44 of plate 45, must slightly exceed the desired adjustment range of slot 5.

Moreover, the lower end of plate 45 is rounded and connects by an inclined face 55 of shaped element 53 to the upstream edge of horizontal face 51. Likewise, the upper face of the lower jaw 42, turned towards chamber 4, has an enlarged part 46 which rises slightly, via an inclined face 56, up to a horizontal face 52 placed in front horizontal face 51 of shaped element 53 and forming the fixed lip of slot 5.

The two opposed faces 55, 56 thus form a nozzle which converges towards slot 5.

Shaped element 53 has, preferably, a U-shaped cross-section, and therefore comprises a horizontal part in the form of an elongated strip stiffened by an inner and outer vertical rib, the inner rib, turned from the side of chamber 4, being delimited by a vertical face 54 which bears against vertical face 44 of plate Furthermore, upper jaw 41 comprises, on the side turned towards strip B, a hollow part 24 in which a plurality of hydraulic, air or grease type jacks 6 are placed, regularly distributed over the entire length of jaw 41, as shown in FIG. 3.

Each jack 6 is a double-action jack and comprises a piston which moves inside a body 61 fixed to jaw 41, and a rod 62 directed vertically downwards whose end is fixed onto a push rod 63 which is mounted so as to slide vertically in the lower part of jaw 41 and whose lower end is fixed to shaped element 53.

When acted upon by jacks 6 and respective push rods 63, the shaped element 53 moves towards or away from the end facing lower jaw 42, this which allows adjustment of the width of slot 5. Adjusting push rods 63 to different positions using their respective jacks makes it possible to vary the longitudinal profile of shaped element 53, and consequently the height of opening 5 over the entire length of such opening. The force of impact of the air knife and consequently the thickness of the zinc deposit can therefore be adjusted over the entire width of strip B.

Thanks to this arrangement, shaped element 53 slides vertically along vertical face 44 of housing 43 on which face 54 of the shaped element continues to bear, the lower edge of plate 45 thus forming a sealing skirt which covers the corresponding edge of flexible shaped element 53 and prevents air from passing between element 53 and jaw 41.

Furthermore, lower face 51 of the shaped element which forms the moving lip delimiting slot 5, extends horizontally over a relatively large distance compared to the height of the slot, horizontal face 52 of lower jaw 42 placed facing face 51 covering the same distance.

As a result, slot 5 has a rectangular cross-section is much longer than it is high and is able to regulate the air flow similarly to a nozzle. To prevent a drop in pressure following a loss of load, the optimal length of the slot must be from four to six times its height.

Furthermore, when the height of slot 5 is being adjusted, deformable lip 53 slides along retaining face 44, and horizontal face 51 of the shaped element 53 therefore moves parallel to itself and to face 52 of lower jaw 42, slot 5 retaining a rectangular cross-section over its entire length.

The air knife thus guided has a lesser tendency to flare and retains all its knife-action impact force over a certain distance between parallel faces 51, 52, which makes it possible to accurately regulate the thickness of the zinc coating.

A relatively large number of jacks 6, possibly 10 to 30, can be used to adjust the profile of deformable lip 53; they are distributed over the whole length of the jaw and spaced so that the difference in the width of opening 5 between two successive jacks does not exceed one millimeter.

Jacks 6 are controlled electronically either from a console by an external operator, or an automatic closed-loop system used to adjust the width of opening 5 at the level of each jack 6 according to, for example, the thickness of the metal deposit on strip B. This thickness can be monitored in real time by thickness gauges (not shown) distributed over the entire width of strip B, possibly using the same number of thickness gauges as there are jacks in order to check the thickness of the deposit in the area facing each jack.

Each jack 6 is associated with a displacement sensor 64, such as an inductive type sensor, which measures the displacement of the jack's piston. Capacitance type sensors without contact 64' could also be used, arranged on lower jaw 42 so as to measure the width of opening 5.

However, the efficiency of the air knife thus produced depends not only on the width of opening 5, but also on the pressure and temperature of the air.

To ensure that air is correctly distributed over the entire length of chamber 3, it is supplied, as shown schematically in FIG. 3, from a collector 2 which extends over the entire length of chamber 3 and which is in air flow communication with the chamber via several regularly distributed tubulures 21. Pressure sensors, also regularly spaced over the length of chamber 8, allow to check the pressure uniformity to be checked, for example means of an adjustable diaphragm 22 placed at the outlet of each tubulure 21.

Air temperature is also measured by one or more sensors 33 distributed over chamber 3, the temperature of the metal part, for example jaw 41, also being measured.

Indeed, because strip B heats the device through radiation as it leaves the galvanization bath, it is necessary to prevent an excessive rise of the temperature of adjustment means 6 and of the sensors, maintaining them, for example, at around 40° C. To this end, an insulating shield 23 can be interposed between strip B and jaw 41. Jaw 41 can also have channels 24 conveying coolant. It is also possible to place an air-blowing boom 25 along the upper part of chamber 3 in the space between insulating panel 23 and jaw 41 so as to cool jaw 41 as well as all the jacks 6 when these are placed outside the jaw.

It is thus possible to maintain the temperature of all the equipment at an appropriate and uniform level. Furthermore, measuring the temperature of jaw 41 allows expansion of the jaw to be taken into account in the automatic closed-loop system controlling the height of opening 5.

However, to perfectly control the thickness of the metal deposit, the vibrations of strip B should also be taken into account; although it is held by stabilization rollers 16, strip B can move slightly about an average position.

Sensors 35 can therefore be distributed along the length of the jaw, for example one at each end and one in the middle, in order to measure the vibrations of the strip on either side of an average position, the corresponding measurement being taken into account in real time by the closed-loop system controlling opening 5. The efficiency of the air knife, which also depends on the strip-to-nozzle distance, is thus enhanced.

It can therefore be seen that the opening profile of the nozzles can be modified according to the width of the strip, thermomechanical deformations of the air knife and, in a general way, all the parameters on which their efficiency depends. This considerably improves the regularity of the zinc deposit. Moreover, the device can also be integrated in a closed-loop control system providing automatic regulation of the thickness of the coating.

It should also be noted that the device in accordance with the invention allows, if necessary, non-uniform adjustment of the thickness of the deposit across the width of the strip since each jack for adjusting the opening of the nozzles corresponds to a specific area across the width of the strip and can be adjusted independently of the others.

Figure 4:
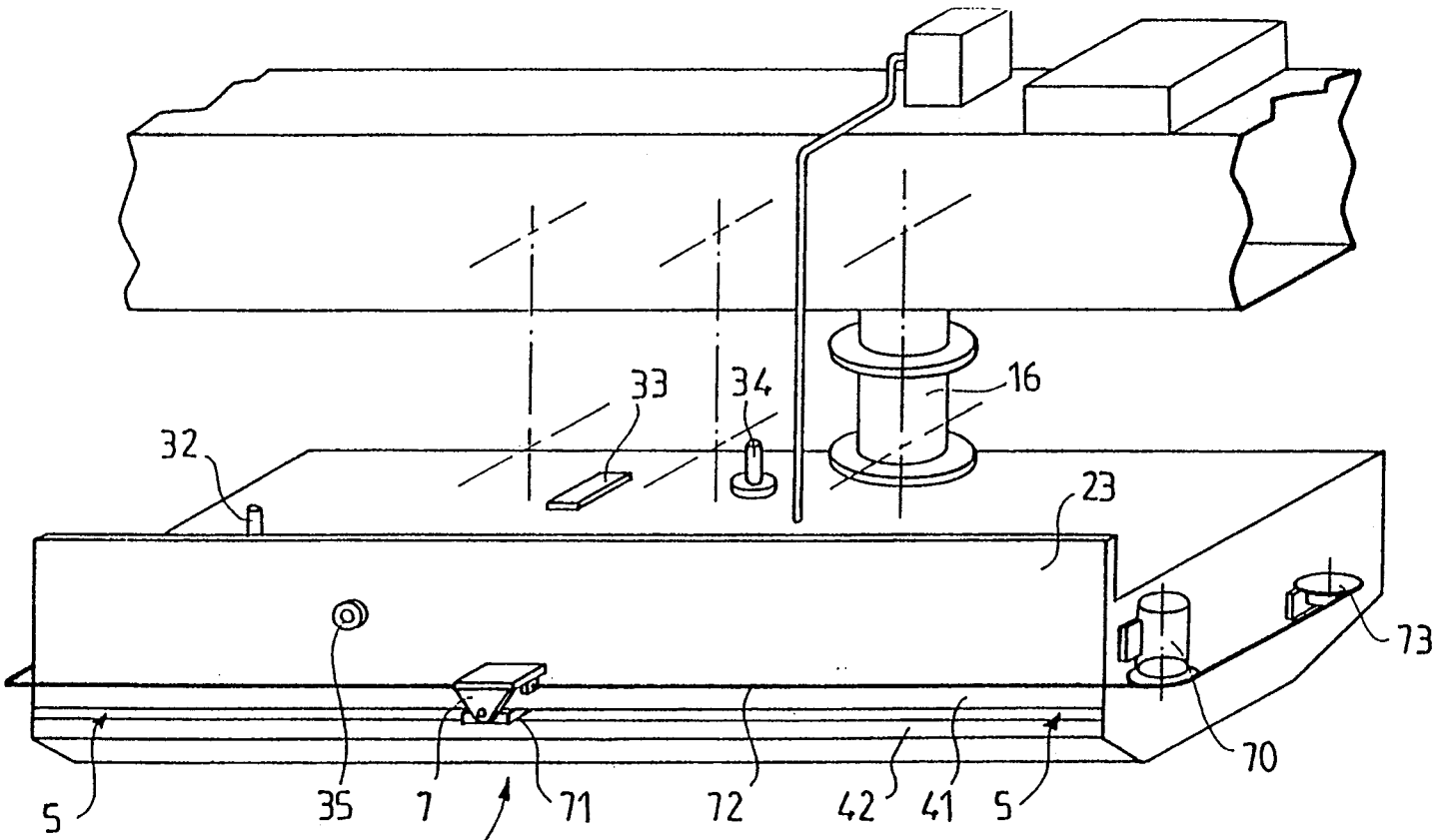
FIG. 4 is a schematic drawing in perspective of the device equipped with cleaning means.

Furthermore, the device can advantageously be completed by cleaning means. Buy way of example, such a unit is shown in FIG. 4 as having means 26 for cleaning slot 5, and which mainly comprise a shuttle or carriage 7 facing strip B and moved by cables 72 along the face of lip 51. This carriage comprises a blade 71 whose length substantially corresponds to the width of the lip and which penetrates into opening 5. The cables pass over pulleys 70 which are driven by motor driving means 73 so as to move shuttle 7 with blade 71 in either direction all the way along opening 5, thus providing automatic cleaning and, consequently, maintenance of the width of opening 5. It should be noted that knife is drawn across slot 5 very quickly and does not interfere with the working of the air knife, so that the thickness and appearance of the coating remains regular.

Cleaning means of this kind avoid the manual interventions necessary with prior art devices, and avoid exposing operators to danger. Moreover, the slots are cleaned much more accurately than is possible by manual cleaning.

The slot 5 cleaning device described above is particularly effective and could be used in other air knife devices.

The jack 6, displacement sensors 64, temperature detectors 33 and 34, and detector 35 for measuring vibrations of strip B are shown in FIG. 4.

We claim:

1. Device for regulating the thickness of a metal deposit formed on a strip emerging from a galvanization bath, said device comprising at least one nozzle for blowing a gaseous fluid, said nozzle having a distribution chamber connected to an air supply circuit and opening into a slot extending transversely over the entire width of said strip, said slot being delimited by narrowly spaced, facing ends of first and second jaws converging towards each other from an outlet of said distribution chamber up to said slot in order to form an air knife, in a direction transverse to a feed plane of said strip, at least one of said first and second jaws comprises a deformable lip made up of a shaped element of elastically deformable material, and having means distributed over the entire length of said at least one of said first and second jaws to adjust a width of said slot, said slot being delimited by first and second flat parallel faces of said jaws determining a direction of said air knife, said first flat face being provided on the deformable lip, said slot extending to an inside of a recess provided at an end of said first jaw and delimited, on the upstream side of an air flow, by a flat retaining face of said jaw substantially perpendicular to the direction of an air knife, said shaped element comprising, on said upstream side, a corresponding guide and sealing face, which bears against said retaining face, said shaped element deforming with planar displacement of said flat face and sliding of said guide face along said retaining face of said first jaw.

2. Regulating device as claimed in claim 1, wherein said first flat face extends, in the direction of said air flow, over a distance equal to several times a maximum width of said slot.

3. Regulating device as claimed in claim 2, wherein said flat face of said deformable lip extends in the direction of said air flow over a distance five times said maximum width of said slot.

4. Regulating device as claimed in any one of claims 1 to 3, wherein said second flat face of the slot is provided on said second jaw and extends, in the air flow direction, over the same distance as said first flat face, and parallel to said first flat face.

5. Regulating device as claimed in any one of claims 1 to 3, wherein the means for adjusting the width of said slot comprise a plurality of jacks regularly distributed over the entire length of said deformable lip.

6. Regulating device as claimed in any one of claims 1 to 3, wherein the shaped element forming the deformable lip comprises a part in the form of an elongated strip on which is provided said first flat face of said slot and, at least on the upstream side, a stiffening rib on which is provided said guide face bearing against said retaining face.

7. Regulating device as claimed in any one of claims 1 to 3, wherein an inner face, facing said chamber, of said first jaw carrying said deformable lip, is covered by a plate prolonged beyond an end, so as to provide, the retaining face delimiting a house in which said deformable lip is placed and forming a sealing skirt that prevents a passage of air between said lip and said first jaw.

8. Regulating device as claimed in any one of claims 1 to 3, further comprising automatic system for adjusting the width of said slot over its entire length according to parameters determining a thickness of a metal deposit on said strip.

9. Regulating device as claimed in claim 8, wherein said automatic adjustment system comprises a plurality of gauges for measuring the thickness of said metal deposit on said strip after it has passed in front of said at least one nozzle, and associated means for slaving the position of said jacks according to the thickness of said metal deposit measured by said gauges.

10. Regulating device as claimed in claim 9, including means for measuring vibrations of the strip with respect to a baseline position, the automatic system taking account of measured vibrations to adjust the width of said slot.

11. Regulating device as claimed in claim 9, including means for measuring the temperature and pressure of said chamber, as well as means for detecting displacement of said jacks, said automatic system responding to detected jack displacement to adjust the width of said slot.

12. Regulating device as claimed in any one of claims 1 to 3, wherein jacks for adjusting the position of said deformable lip are placed in a hollow part provided on an outer face of said first jaw.

13. Regulating device as claimed in claim 12, wherein each of said jacks actuates a push rod mounted in sliding fashion on said first jaw and fixed, at an opposite end of said push rod, to an inner face of said shaped element opposite the first flat face of said slot.

14. Regulating device as claimed in any one of claims 1 to 3, wherein said first jaw extends in a substantially vertical direction and parallel to said strip emerging from said galvanization bath, said second jaw extending in a direction substantially parallel to a surface of said bath.

15. Regulating device as claimed in claim 14, wherein said jacks are located in a hollow part provided on an outer face of said first jaw, an insulating shield being fixed on said first jaw and is interposed between said strip and said jacks and closing said hollow part towards the outside.

16. Regulating device as claimed in any one of claims 1 to 3, wherein each nozzle has a device for cleaning said slot, said device comprising a blade penetrating between the facing ends of the two jaws and extending over the entire width of said lips, said blade being mounted on a carriage which travels along the two jaws over the entire length of said slot and having means for controlling displacement of said carriage.

17. Galvanization equipment comprising the air knife device as claimed in any one of claims 1 to 3.

* * * * *